United States Patent [19]

Kobayashi et al.

[11] Patent Number: 4,744,872

[45] Date of Patent: May 17, 1988

[54] ANODIZING SOLUTION FOR ANODIC OXIDATION OF MAGNESIUM OR ITS ALLOYS

[75] Inventors: Waichi Kobayashi; Kinji Uehori; Masashi Furuta, all of Ube, Japan

[73] Assignee: Ube Industries, Ltd., Yamaguchi, Japan

[21] Appl. No.: 30,941

[22] Filed: Mar. 26, 1987

[30] Foreign Application Priority Data

May 30, 1986 [JP] Japan ..... 61-123223
Nov. 14, 1986 [JP] Japan ..... 61-269562

[51] Int. Cl.[4] ..... C25D 11/30
[52] U.S. Cl. ..... 204/58.4
[58] Field of Search ..... 204/58.4; 106/14.21; 428/688

[56] References Cited

U.S. PATENT DOCUMENTS 2,512,563 6/1950 DeLong ..... 204/56
4,551,211 11/1985 Kobayashi et al. ..... 204/37.6

FOREIGN PATENT DOCUMENTS 474570 7/1951 Canada ..... 204/58.4
622215 4/1949 United Kingdom ..... 204/56

OTHER PUBLICATIONS

Handbook of Chem. & Physics, 32nd ed, 1951, pp. 908–909.

Annual Book of ASTM Standard, part 27, D 1732 (1974).

*Primary Examiner*—R. L. Andrews
*Attorney, Agent, or Firm*—Flynn, Thiel, Boutell & Tanis

[57] ABSTRACT

An novel solution for anodic oxidation of magnesium or magnesium alloy is prepared by dissolving silicate, carboxylate and alkali hydroxide in water. The anodic oxidation coating formed on the surface of magnesium or its alloy using the anodizing solution has a superior combination of properties, especially with respect to corrosion resistance, abrasion resistance and ornamental properties, as compared to any prior art anodic oxidation coating. The solution may further contains one or more compounds selected from the group consisting of borate, fluoride and phosphate, in addition to the foregoing essential components in order to obtain a further improvement.

12 Claims, No Drawings

ANODIZING SOLUTION FOR ANODIC OXIDATION OF MAGNESIUM OR ITS ALLOYS

BACKGROUND OF THE INVENTION

1. Field of the Invention

This invention relates to an anodizing solution for anodic oxidation of magnesium or its alloys.

More specifically, the present invention relates to an anodizing solution which is capable of forming an anodic oxidation coating having superior properties, particularly with regard to corrosion resistance and abrasion resistance, onto the surface of magnesium or magnesium alloys.

2. Description of Prior Art

Among the practical metallic materials, magnesium and its alloys are lightest and are superior in the mechanical properties. However, since they are chemically active and inferior in corrosion resistance, their practical application has been limited. Therefore, various surface treatments have been heretofore proposed and practiced.

The known surface treatments of magnesium and magnesium alloys may be divided roughly into the two groups i.e., a chemical conversion process and an anodic oxidation process.

The chemical conversion process comprises the steps of immersing magnesium or its alloys in a treating solution containing chromate or manganate as a main component and thereby chemically forming a corrosion protection coating, and, for example, includes the processes described as Classes 1 to 4 and 7 in JIS (Japanese Industrial Standard)-H-8651 (1978). On the other hand, in the anodic oxidation process, magnesium or magnesium alloy is immersed in a treatment solution containing, for example, aluminate, fluoride and chromate, as main components and an oxide coating is electrochemically formed by applying an alternating current or a direct current. Examples of such an anodic oxidation process include the processes specified as Classes 5 and 6 in JIS-H-8651 (1978), the HAE process specified in MIL Standard (MIL-M45202B) and the Dow 17 process.

However, these conventional processes are all unsatisfactory and have some problems to be improved. For example, the chemical conversion process has been employed for the purpose of tentative corrosion protection or under coating and a long-period corrosion resistance can not be ensured. Further, the coating formed is considerably poor in abrasion resistance.

On the other hand, although among the anodic oxidation processes the HAE process and the Dow 17 process set forth above are relatively advantageous, most processes indispensably need a certain system for treating mist which is generated from the treatment bath during the anodic oxidation processing operation and a waste water treatment system, since the treatment solutions contain heavy metal(s), such as manganese or chromium. Such systems are costly and, thus, economically disadvantageous.

SUMMARY OF THE INVENTION

An object of the present invention is to provide a novel anodizing solution for anodic oxidation of magnesium or magnesium alloys, the solution being prepared by dissolving silicate, carboxylate and alkali hydroxide in water.

Further, the present invention is directed to another novel anodizing solution for anodic oxidation of magnesium or magnesium alloys which is prepared by dissolving one or more compounds selected from the group consisting of borate, fluoride and phosphate in the solution set forth above.

The anodizing solution according to the present invention is made up of a group of main components essential for the formation of an oxide coating and a group of assistant components. Addition of the assistant components to the main components imparts a further improvement in the quality of the formed coating, although a hard oxide coating with an excellent abrasion resistance can be formed from a solution consisting only of the main components.

As the main components, silicates, carboxylates and alkali hydroxides may be employed and, as the assistant components, borates, fluorides and phosphates may be employed. When magnesium or its alloy is subjected to the anodic oxidation treatment with an anodizing solution prepared by mixing the above components in appropriate amounts, a glassy oxide coating consisting mainly of forsterite ($2MgO \cdot SiO_2$) is formed onto the surface of magnesium or its alloy and such a coating has been found to have a maximum thickness of 30 $\mu$m. The oxide coating is white in the color and it has been found that, in comparison with the anodic oxidation coatings heretofore known, such as a dark brown coating by the HAE process or a dark green coating by the Dow 17 process, the oxide coating of the present invention is not only superior in ornamental and decorative aspects but also advantageous in corrosion resistance and abrasion resistance properties.

DETAILED DESCRIPTION OF THE PREFERRED EMBODIMENTS

In the present invention, the compounds constituting the anodizing solution of the present invention are preferably used as alkali metal salts in view of their solubility in water and their amounts are as follows. In the present specification, all the addition amounts are stated with respect to the volume of the anodizing solution, unless otherwise indicated. Silicate: 30 to 150 g/l, Carboxylate: 10 to 120 g/l, Alkali hydroxide: 30 to 150 g/l, Borate: 5 to 50 g/l, Fluoride: 1 to 30 g/l, Phosphate: 5 to 50 g/l When anodic oxidation process is carried out on magnesium or its alloy using the anodizing solution of the present invention, chromate, for example, bichromate may be further added in the preferred range of 2.5 to 30 g/l to the solution, if a much higher corrosion resistance is desirable. However, in this case, a certain system for treating chromium is required.

There is no specific limitation on metallic materials to be treated with the anodizing solution of the present invention, as long as they are magnesium or its alloys. The anodic oxidation treatment is applicable to general structural materials and industrial materials containing magnesium in amounts of 70% or more and other elements, for example, aluminum, zinc, manganese, zirconium, silicon, rare earth metals, etc.

The examples of the silicate include lithium silicate, sodium silicate and potassium silicate and the amount of the silicate is appropriately in the range of 30 to 150 g/l with the preferred range being between 50 g/l and 100 g/l. When the amount of silicate is insufficient, it is difficult to form an oxide coating of high quality on the surface of magnesium or its alloy. While an excess use of the silicate allows the precipitation of other components dissolved in the anodizing solution and, thus, is undesirable.

As the carboxylate, water-soluble salts are preferable and the examples may be alkali metal salts of various carboxylic acids such as monocarboxylic acids (for example, formic acid, acetic acid and propionic acid), dicarboxylic acids (for example, oxalic acid, malonic acid and succinic acid), and oxycarboxylic acids (for example, lactic acid, tartaric acid and citric acid). The carboxylate is usually used in amounts within the range of 10 to 120 g/l, with the preferred range being from 40 to 80 g/l. An insufficient addition of the carboxylate can not produce a sufficient effect, while even when an excess carboxylate is added, any further advantageous effect can not be expected. The effect imparted by the addition of this component means an effect of densifying the texture of the formed anodic oxidation coating. It is assumed that magnesium salt of carboxylic acid produced on the surface of magnesium or its alloy by the addition of the carboxylate relates to the density of the coating.

The alkali hydroxide is, for example, lithium hydroxide, sodium hydroxide or potassium hydroxide and its addition amount is preferably in the range of 30 to 50 g/l, more preferably in the range of 60 to 120 g/l. When the amount of the alkali hydroxide is too small, the decomposition voltage to form an anodic oxidation coating becomes too high and the texture of the formed coating becomes rough. On the other hand, when the addition is excess, an excessive current will flow in the anodizing bath and the dissociation voltage of magnesium or its alloy will not reach the desired level.

As set forth above, although there can be obtained a dense and hard anodized coating by using the anodizing solution prepared only from main components, the following additives will provide a further improvement in the properties of the coating.

The preferred examples of the borate are lithium metaborate, sodium metaborate and potassium metaborate and the borate is preferably used in amounts of 5 to 50 g/l, more preferably in amounts of 10 to 40 g/l. When the amount of the borate is insufficient, an anodic oxidation coating is not satisfactorily developed and will not reach the desired level in its thickness. Further, the abrasion resistance of the coating is insufficient. On the other hand, an excess use is unfavorable, since the borate component in excess is not successfully dissolved in the anodizing solution.

As the fluoride, lithium fluoride, sodium fluoride or potassium fluoride may be used in a proper amount within range of 1 to 30 g/l, with the preferred range of 2 to 20 g/l. When the amount of the fluoride is too small, the quality of the anodic oxidation coating will be deteriorated. When the fluoride addition is excessive, sparks will be concentrated on the surface of magnesium or its alloy, thereby presenting difficulties not only in the anodic oxidation operation under normal conditions but also in dissolving the fluoride in the anodizing solution.

The examples of the phosphate are trilithium phosphate, trisodium phosphate and tripotassium phosphate and the amount of the phosphate is preferably in the range of 5 to 50 g/l, more preferably 10 to 30 g/l. An insufficient alkali phosphate adversely affects the formation rate of an anodic oxidation coating and thereby makes difficult the attainment of the desired coating thickness. On the other hand, an excess addition of the phosphate will result a porous anodic oxidation coating and thereby tend to cause the lowering the abrasion resistance.

In preparing the anodizing solution according to the present invention, although two or more compounds may be selected from each of the groups of the compounds stated above, it is more preferable to select one compound from each group and mix the selected compounds to give the solution.

When the anodizing solution thus prepared is employed for the anodic oxidation of magnesium or its alloy, there can be formed a white hard coating having a superior corrosion resistance and a greatly improved abrasion resistance. However, when a further high level of corrosion resistance is desired, chromate may be added to the anodizing solution and, in this case, the resulting oxide coating becomes greyish green in its color.

As the chromate, alkali metal salts of chromic acids, for example, sodium bichromate and potassium bichromate may be employed preferably in the range of 2.5 to 30 g/l, more preferably 5 to 20 g/l. When the addition amount of the chromate is insufficient, the effect imparted by the addition is slight, while an excess addition makes the resulting anodic oxidation coating rough and lowers its corrosion resistance and abrasion resistance.

In practicing the anodic oxidation of magnesium or its alloy with the anodizing solution of the present invention, the solution is adjusted at temperatures of 20° to 60 ° C. When the solution temperature is lower than this temperature range, the components constituting the anodizing solution may precipitate. Temperatures higher than the range cause the resulting oxide coating to partially dissolve and thereby make it difficult to obtain the desired coating thickness. Further, such high temperatures will cause a rapid evaporation of water from the anodizing solution and require a certain means of preventing this. The current density during the anodic oxidation process is adjusted preferably in the range of 0.2 to 5 A/dm$^2$, more preferably 1 to 4 A/dm$^2$. When the current density is too low, a glassy oxide coating can not be readily obtained and both corrosion resistance and abrasion resistance become low. When the current density is too high, sparking will intensively occur on a certain part of the surface of magnesium or its alloy and, in some cases, a uniform oxide coating can not be formed. In the anodic oxidation process heretofore practiced, a special means of avoiding a burning of the coating caused due to such an intensive sparking has been taken. In contrast to this, the anodic oxidation treatment with the anodizing solution of the present invention is free of such a burning and is advantageous.

The article surface-treated with the solution of the present invention may be employed in an intended use after washing with water and drying, without requiring any further treatment. However, when the article is further immersed in a chromate solution, washed with water and dried, in a accordance to an after treatment manner heretofore known, the resulted coating is further stabilized and improved in the corrosion resistance.

The present invention will be described now in more detail by way of the following Examples and Comparative Examples, but the scope of this invention is not limited to the Examples.

In the Examples and Comparative Examples, the corrosion resistance test was conducted on the test pieces having subjected to the following anodic oxidation process, in accordance with "Methods of Salt Spray Testing" specified in JIS (Japanese Industrial Standard)-Z-2371. Each test specimen was subjected to salt spray for a period of 48 hours and then measured the corrosive weight loss due to the salt spray.

The abrasion resistance test was conducted in accordance with "Test Methods for Abrasion Resistance of Anodic Oxidation Coating on Aluminum and Aluminum Alloys" described in JIS-H-8682 in which each anodized test specimen was subjected to a plane abrasion resistance test [load: 400 gf (3.92 N), number of double stroke wearing action: 60 DS/min.; abrasive paper: #320, abrasive: SiC] and measured the number of the double stroke wearing action (DS number) of an abrasive wheel required for abrasively removing the surface of 1 μm thick from the test piece.

Specimens with dimensions of 60 mm (length)×50 mm (width) were cut out of a magnesium alloy sheet (AZ 31, 3 mm in thickness) and were anodically oxidized as set forth below.

EXAMPLES 1 to 5

The specimens were polished by an abrasive paper (#400) and then cleaned with an alkali and an acid. The specimens thus treated were anodically oxidized using aqueous anodizing solutions containing the compounds shown in Table 1 and the contents of the respective compounds are given by g/l, i.e., weight (g) per one liter of the solution. The anodizing conditions were as follows.

Temperature of the anodizing solution: 30° C.

Current density (alternating current): 3 A/dm$^2$ (Voltage: 50 to 100 V)

Processing Period: 30 minutes

The anodized specimens obtained were washed with water and dried.

EXAMPLE 6

The specimen was anodized under the same processing conditions as in Example 5 except that sodium bichromate (10 g/l) was dissolved in the anodizing solution of Example 5.

EXAMPLE 7

The specimen was subjected to the same anodic oxidation treatment as in Example 5 using the anodizing solution of Example 5 except that the applied alternating current density was changed to 1.5 A/dm$^2$.

EXAMPLE 8

The specimen was subjected to the same anodic oxidation treatment as in Example 5 using the anodizing solution of Example 5 except that the temperature of the anodizing solution was changed to 50° C.

EXAMPLE 9

The anodized specimen obtained in Example 5 was immersed in an aqueous after-treatment solution containing 50 g/l of sodium bichromate and 50 g/l of potassium bifluoride for a period of three minutes, washed with water and dried.

EXAMPLE 10

The anodized specimen obtained in Example 6 was immersed in the same after-treatment solution as in Example 9 for a period of three minutes, washed with water and dried.

EXAMPLES 11 to 16

The specimens were subjected to the same anodic oxidation treatment as in Example 1 except that the anodizing solutions was replaced by each of the aqueous anodizing solutions containing the compounds shown in Table 1 and the contents of the respective compounds are also given by g/l, i.e., weight (g) per one liter of the solution.

The specimens thus anodized were washed and then after-treated with the same after-treatment solution set forth in Example 9.

EXAMPLE 17

The specimen was subjected to the same anodic oxidation treatment as in Example 13 using the anodizing solution of Example 13 except that the applied alternating current density was changed to 1.5 A/dm$^2$.

EXAMPLE 18

The specimen was subjected to the same anodic oxidation treatment as in Example 15 using the anodizing solution of Example 15 except that the temperature of the anodizing solution was changed to 50° C.

COMPARATIVE EXAMPLE 1

In accordance with the HAE process heretofore known, there was prepared an aqueous anodizing solution containing of 35 g/l of aluminum hydroxide, 165 g/l of potassium hydroxide, 35 g/l of potassium fluoride, 35 g/l of trisodium phosphate and 20 g/l of potassium permanganate and, using the anodizing solution thus prepared, the AZ 31 magnesium alloy specimen used in the Examples was subjected to anodic oxidation treatment under the following processing conditions.

Temperature of the anodizing solution: 20° C.

Current density (alternating current): 2 A/dm$^2$

Processing Period: 30 minutes

COMPARATIVE EXAMPLE 2

In accordance with the known Dow 17 process, there was prepared an aqeous anodizing solution containing 240 g/l of ammonium bifluoride, 100 g/l of sodium bichromate and 90 ml/l of a 85% phosphoric acid and, using the anodizing solution thus prepared, anodic oxidation process was carried out on the AZ 31 magnesium alloy specimen used in the Examples under the following processing conditions.

Temperature of the anodizing solution: 80° C.

Current density (alternating current): 2.8 A/dm$^2$

Processing Period: 30 minutes

COMPARATIVE EXAMPLE 3

The specimen anodized in Comparative Example 1 was washed with water and then after-treated by immersing in a treating solution consisting of 20 g/l of sodium bichromate and 100 g/l of ammonium bifluoride, the balance being water.

Table 2 shows the coating thickness, the results of the corrosion resistance test and the abrasion test and the hue for each of the above surface-treated test specimens of Examples 1 to 18 and Comparative Examples 1 to 3.

TABLE 1

| Example No. | Sodium Silicate | Composition of Anodizing Solution (g/l), Balance: Water | | | | | |
|---|---|---|---|---|---|---|---|
| | | Carboxylate | Sodium Hydroxide | Sodium Metaborate | Trisodium Phosphate | Potassium Fluoride | Sodium Bichromate |
| 1 | 80 | 60 Trisodium Citrate | 100 | — | — | — | — |
| 2 | 80 | 60 Trisodium Citrate | 100 | — | 10 | 5 | — |
| 3 | 80 | 60 Trisodium Citrate | 100 | 20 | — | 5 | — |
| 4 | 80 | 60 Trisodium Citrate | 100 | 20 | 10 | — | — |
| 5 | 80 | 60 Trisodium Citrate | 100 | 20 | 10 | 5 | — |
| 6 | 80 | 60 Trisodium Citrate | 100 | 20 | 10 | 5 | 10 |
| 7 | 80 | 60 Trisodium Citrate | 100 | 20 | 10 | 5 | — |
| 8 | 80 | 60 Trisodium Citrate | 100 | 20 | 10 | 5 | — |
| 9 | 80 | 60 Trisodium Citrate | 100 | 20 | 10 | 5 | — |
| 10 | 80 | 60 Trisodium Citrate | 100 | 20 | 10 | 5 | 10 |
| 11 | 80 | 25 Sodium Acetate | 100 | 10 | 5 | 5 | — |
| 12 | 80 | 50 Sodium Oxalate | 100 | 10 | 5 | 5 | — |
| 13 | 80 | 60 Trisodium Citrate | 100 | 10 | 5 | 5 | — |
| 14 | 80 | 60 Trisodium Citrate | 100 | 20 | 5 | 5 | — |
| 15 | 80 | 60 Trisodium Citrate | 100 | — | — | 5 | — |
| 16 | 80 | 60 Trisodium Citrate | 100 | 10 | 5 | 5 | 10 |

Remark: Sodium silicate was used in the powder state and its composition consists of 50 to 55% of $SiO_2$ and 23 to 27% of $Na_2O$.

TABLE 2

| | Coating Thickness (μm) | Corrosion Resistance (Corrosion Weight Loss g/m$^2$) | Abrasion Resistance (DS/μm) | Hue |
|---|---|---|---|---|
| Example No. | | | | |
| 1 | 12 | 3.1 | 50 | White |
| 2 | 17 | 2.6 | 53 | White |
| 3 | 15 | 2.8 | 64 | White |
| 4 | 18 | 2.7 | 65 | White |
| 5 | 18 | 2.2 | 70 | White |
| 6 | 21 | 0.3 | 66 | Greyish Green |
| 7 | 10 | 5.9 | 50 | White |
| 8 | 16 | 2.0 | 64 | White |
| 9 | 18 | 0.2 | 70 | White |
| 10 | 21 | 0.1 | 67 | Greyish Green |
| 11 | 13 | 2.6 | 36 | White |
| 12 | 10 | 1.7 | 44 | White |
| 13 | 17 | 0.0 | 61 | White |
| 14 | 18 | 0.2 | 70 | White |
| 15 | 15 | 0.1 | 53 | White |
| 16 | 18 | 0.0 | 57 | Greyish Green |
| 17 | 10 | 0.3 | 49 | White |
| 18 | 16 | 0.0 | 55 | White |
| Comparative Example No. | | | | |

TABLE 2-continued

| | Coating Thickness (μm) | Corrosion Resistance (Corrosion Weight Loss g/m²) | Abrasion Resistance (DS/μm) | Hue |
|---|---|---|---|---|
| 1 | 22 | 6.4 | 14 | Dark Brown |
| 2 | 34 | 12.6 | 8 | Dark Green |
| 3 | 32 | 6.4 | 18 | Dark Brown |

The anodic oxidation coatings formed on the surface of magnesium or its alloy using the anodizing solution of the present invention are superior in corrosion resistance, abrasion resistance and ornamental properties, particularly with respect to abrasion resistance, as compared to the known anodic oxidation coatings. Further, since the anodizing solution of the present invention is alkaline and the processing temperature is near room temperature, an elecrolytic bath may be made of, for example, iron or plastics. Therefore, the anodizing solution of the present invention is also economically advantageous.

What is claimed is:

1. An aqueous anodizing solution for anodic oxidation of an article of magnesium or magnesium alloy, which contains dissolved therein, per one liter of said solution, from 30 to 150 grams of a silicate, from 10 to 120 grams of a carboxylate and from 30 to 150 g of an alkali hydroxide.

2. An aquoeus anodizing solution as claimed in claim 1 in which said carboxylate is an alkali metal citrate.

3. An aqueous solution as claimed in claim 1 in which said carboxylate is an alkali metal salt of a carboxylate acid selected from the group consisting of formic acid, acetic acid, propionic acid, oxalic acid, malonic acid, succininc acid, lactic acid, tartaric acid and citric acid.

4. An aqueous solution as claimed in claim 1 in which said carboxylate is selected from the group consisting of trisodium citrate, sodium acetate and sodium oxalate.

5. An aqueous solution as claimed in claim 3 in which said silicate is selected from the group consisting of lithium silicate, sodium silicate and potassium silicate, and said alkali hydroxide is selected from the group consisting of lithium hydroxide, sodium hydroxide and potassium hydroxide.

6. An aqueous solution as claimed in claim 5 containing 50 to 100 g/l of said silicate, 40 to 80 g/l of said carboxylate and 60 to 120 g/l of said alkali hydroxide.

7. An aqueous solution as claimed in claim 1 additionally containing dissolved therein at least one compound selected from the group consisting of borates, fluorides and phosphates.

8. An aqueous solution as claimed in claim 1, additionally containing dissolved therein at least one of (a) from 5 to 50 g/l of a borate selected from the group consisting of lithium metaborate, sodium metaborate and potassium metaborate, (b) from 1 to 30 g/l of a fluoride selected from the group consisting of lithium fluoride; sodium fluoride and potassium fluoride, and (c) from 5 to 50 g/l of a phosphate selected from the group consisting of trilithium phosphate, trisodium phosphate and tripotassium phosphate.

9. An aqueous solution as claimed in claim 1, additionally containing a chromate dissolved therein.

10. An aqueous solution as claimed in claim 1, additionally containing dissolved therein from 2.5 to 30 g/l of a chromate selected from the group consisting of sodium bichromate and potassium bichromate.

11. A process which comprises anodizing a surface of an article of magnesium or magnesium alloy by contacting said surface with an aqueous solution as claimed in claim 9, at a temperature of from 20° to 60° C. and at a current density of from 0.2 to 5 A/dm², to form a layer consisting essentially of forsterite ($2MgO \cdot SiO_2$) on said surface.

12. An article prepared by the process of claim 11.

* * * * *

UNITED STATES PATENT AND TRADEMARK OFFICE

CERTIFICATE OF CORRECTION

PATENT NO. : 4 744 872

DATED : May 17, 1988

INVENTOR(S) : Waichi KOBAYASHI et al

It is certified that error appears in the above-identified patent and that said Letters Patent is hereby corrected as shown below:

Column 9, Line 31; Change "aquoeus" to ---aqueous---.

Column 10, Line 37; Change "aqueous solution" to ---aqueous anodizing solution---.

Column 10, Line 38; Change "Claim 9" to ---Claim 1---.

Signed and Sealed this

Eleventh Day of October, 1988

*Attest:*

DONALD J. QUIGG

*Attesting Officer*

*Commissioner of Patents and Trademarks*